United States Patent [19]

Strothmann et al.

[11] Patent Number: 4,539,439

[45] Date of Patent: Sep. 3, 1985

[54] PLUGS, RECEPTACLES AND HEARING AIDS

[75] Inventors: Rolf Strothmann, Innerkip; Rolf Dohmer, Kitchener, both of Canada

[73] Assignee: Unitron Industries Ltd., Kitchener, Canada

[21] Appl. No.: 485,912

[22] Filed: Apr. 18, 1983

[51] Int. Cl.[3] ..... H04R 25/00

[52] U.S. Cl. ..... 179/107 R; 381/69; 339/17 F; 339/32 R; 179/107 H

[58] Field of Search ..... 179/107 R, 107 H, 107 S, 179/95; 339/32 R, 32 M, 33, 28, 91 R, 256 SP, 258 R, 17 F, 17 L

[56] References Cited

U.S. PATENT DOCUMENTS

| | | | |
|---|---|---|---|
| 2,673,898 | 3/1954 | Reichert | 174/107 R |
| 2,848,538 | 8/1958 | Randolph | 179/107 R |
| 3,393,392 | 7/1968 | Shelley | 339/17 F |
| 3,605,060 | 9/1971 | Pragger | 339/17 F |
| 4,134,045 | 1/1979 | Quin | 339/28 |
| 4,258,969 | 3/1981 | Stallard | 339/32 R |
| 4,405,190 | 9/1983 | Schroeder | 339/32 R |

FOREIGN PATENT DOCUMENTS

| | | | |
|---|---|---|---|
| 3006365 | 6/1980 | France | 179/107 R |

OTHER PUBLICATIONS

A. W. Nortrop, et al, "Isolation Circuit Tool," IBM Tech. Discl. Bull., vol. 3, No. 1, Jun. 1960, p. 7.

*Primary Examiner*—Gene Z. Rubinson
*Assistant Examiner*—L. C. Schroeder
*Attorney, Agent, or Firm*—Rogers, Bereskin & Parr

[57] ABSTRACT

A connecting cord has a plug at each end. Either such plug may be plugged into the receptacle of a hearing aid and the other plug may be plugged into an external microphone. The contacts of each plug are connected in a different circuit configuration to the conductors of the cord so that when one plug is plugged into the receptacle, the internal hearing aid microphone is shorted out, and when the other plug is plugged into the receptacle, both microphones operate in parallel. The plug contacts are formed of printed circuit board and each plug has a rocker with a hooked top which engages a slot in the receptacle to prevent the inadvertent movement of the plug out of the receptacle. Other plug internal circuit configurations allow connection of other signalling systems to the hearing aid.

13 Claims, 18 Drawing Figures

PLUGS, RECEPTACLES AND HEARING AIDS

This invention relates to improvements in plugs and receptacles and to an improved audio input system for a hearing aid.

Hearing aids normally include an internal microphone, the function of which is to produce an electrical signal dependent upon sound waves received by the microphone. The signal is amplified, transduced into an amplified sound wave and directed to the user's ear. It is, however, commonly required to feed audio signals into the hearing aid from an external source, for example an external microphone, an FM teaching system, or a tape recorder or the like. The signal from the external source in some cases preferably replaces the signal from the internal hearing aid microphone, resulting in improved reception and signal to noise ratio. In other cases, the signal from the external source must be fed into the hearing air amplifier in parallel with the signal from the internal hearing aid microphone. In the past, these alternative functions have at best been awkward to achieve and were not available with many hearing aids.

Accordingly, it is an object of the present invention in one of its aspects to provide an improved electrical connecting cord having different plugs at each end, either of which may be plugged into a single receptacle, to make different electrical connections within the receptacle depending on which plug is used. To this end the invention provides an electrical connection cord having a first plug at one end thereof and a second plug at the other end thereof, said cord having a plurality of conductors joining the plugs, each plug having a plurality of contacts, the contacts of said first plug being connected to said conductors in a first circuit configuration, the contacts of said second plug being connected to said conductors in a second circuit configuration different from said first circuit configuration, the contacts of both said plugs being adapted to be plugged one plug at a time into a single receptacle, whereby an electrical connection to said receptacle may be varied dependent on which of said plugs is plugged into said receptacle.

In another aspect, the invention provides an electrical connection cord and receptacle combination comprising:

(a) a receptacle having a plurality of receptacle contacts, (b) an electrical connection cord having a first plug at one end thereof and a second plug at the other end thereof, said cord having a plurality of conductors joining said plugs, each plug having a plurality of contacts, the contacts of said first plug being connected to said conductors in a first circuit configuration, the contacts of said first plug being connected to said conductors in a first circuit configuration, the contacts of said second plug being connected to said conductors in a second circuit configuration different from said first circuit configuration, (c) the contacts of both said plugs being adapted to be plugged one plug at a time into said receptacle, whereby an electrical connection to said receptacle may be varied dependent on which of said plugs is plugged into said receptacle.

In still another aspect of the invention, the receptacle is part of a hearing aid, said hearing aid including an internal microphone, said first circuit configuration including means when said first plug is in said receptacle to turn off said internal microphone, said second circuit configuration including means when said second plug is in said receptacle to leave said internal microphone in operative condition.

In yet another aspect the invention provides an electrical plug having a housing, contacts projecting from said housing, and rocker means mounted on said housing for rocking movement, said rocker means including a portion projecting beyond said housing, said portion including engagement means protruding therefrom for engaging and locking said plug to a receptacle into which said plug is connected.

In still another aspect the invention provides an electrical plug having a housing, a printed circuit board projecting from said housing, said printed circuit board having conductors formed thereon, said conductors constituting contacts of said plug.

Further objects and advantages of the invention will appear from the following description taken together with the accompanying drawings in which.

Figure 1:
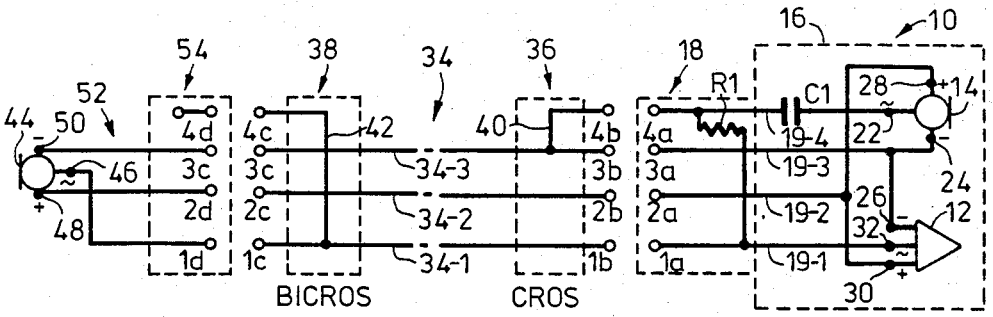
FIG. 1 is an electrical schematic view showing a hearing aid, receptacle, cord and external microphone connected together according to the invention.

Reference is first made to FIG. 1 which shows a hearing aid generally indicated at 10. Only the main electrical components of the hearing aid are shown, namely an amplifier 12 and an internal microphone 14 both within a housing indicated in dotted outline at 16. The remaining portions of the hearing aid which are all entirely conventional are not shown in FIG. 1.

The hearing aid 10 includes a receptacle 18 formed in one plastic half of its housing (as will be explained). The receptacle 18 includes four female contacts, 1*a*, 2*a*, 3*a* and 4*a*. Contacts 1*a* and 4*a* are connected together through a 5.6K resistor R1. Contact 4*a* is connected by conductor 19-4 through capacitor C1 to the signal output terminal 22 of internal microphone 14. Terminal 3*a* is connected by a conductor 19-3 to the negative terminal 24 of the microphone and also to the negative terminal 26 of amplifier 12. Contact 2*a* is connected by a conductor 19-2 to the positive terminal 28 of microphone 14 and also to the positive terminal 30 of amplifier 12. Contact 1*a* is connected by conductor 19-1 to the signal input terminal 32 of amplifier 12.

Also shown in FIG. 1 is a cord 34 having a first plug 36 at one end thereof and a second plug 38 at the other end thereof. The plugs 34, 36 are marked Cros and Bicros for reasons to be explained shortly.

Plug 36 has male contacts 1*b* to 4*b* respectively and plug 38 has male contacts 1*c* to 4*c* respectively. The respective pairs of plug contacts 1*b* and 1*c*, 2*b* and 2*c*, and 3*b* and 3*c* are connected together by conductors 34-1, 34-2 and 34-3 respectively. Contacts 3*b*, 4*b* are connected directly together by conductor 40 and contact 1*c*, 4*c* are connected directly together by conductor 42.

Also shown in FIG. 1 is an external microphone 44 having a signal output terminal 46 with positive and negative terminals 48, 50. External microphone 44, which is assumed to be a hearing aid microphone similar to or identical with internal microphone 14, is connected by a cord 52 to a receptacle 54 which is similar to receptacle 36 in that it can receive either of plugs 36, 38.

Receptacle 54 has four female contacts 1*d* to 4*d*, of which contacts 1*d* to 3*d* are connected respectively to terminals 46, 48 and 50. No connections are made to terminal 4*d*.

Figure 2:
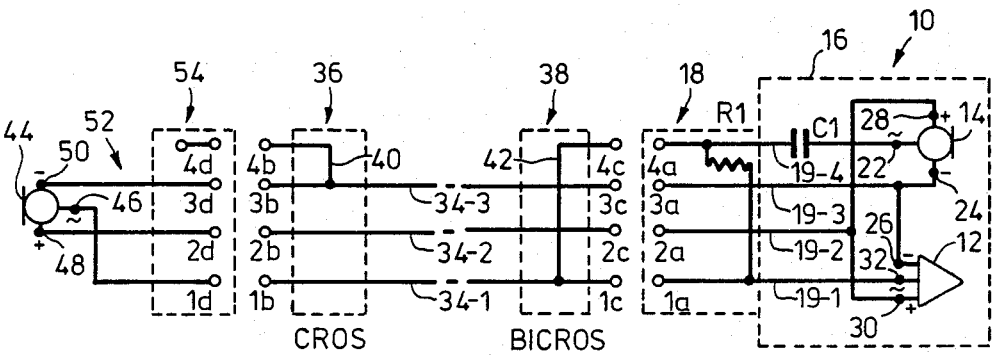
FIG. 2 is a view similar to that of FIG. 1 but showing the cord reversed.

FIG. 2 shows an arrangement identical with that of FIG. 1 except that cord 34 has been reversed so that the Bicros plug 38 is now connected to the hearing aid receptacle 18 and the Cros plug 36 is connected to the external microphone 44.

The operation of the FIG. 1 and 2 arrangement is as follows. Firstly, assume that neither plug 36, 38 of the cord 34 is plugged into the hearing aid receptacle 18, i.e. consider simply the hearing aid 10 and its associated receptacle. In this configuration, with nothing plugged into the receptacle 18, the hearing aid internal microphone signal terminal 22 is connected through the resistor Rl to the amplifier signal input terminal 32 and sound is produced at the user's ear dependent on soundwaves received by the internal microphone 14. The hearing aid 10 therefore operates normally.

Next assume that the cord 34 has the Cros plug 36 plugged into receptacle 18 and the Bicros plug 38 plugged into receptacle 54 as shown in FIG. 1. In this configuration, the contacts 3*b*, 4*b* of the Cros plug 36, which are connected together, short-circuit terminals 22, 24 of the internal microphone 14 together, thus cutting out the internal microphone. However, signals from the external microphone 44 are directed through cord 34 to the amplifier 12, so that the user hears sound received at the external microphone 44. The presence of resistor R1 in the conductor joining terminals 1*a*, 4*a* prevents the inputs from the external microphone 44 from being short circuited by conductor 40 between contacts 3*b*, 4*b*.

Next consider the arrangement shown in FIG. 2, in which the cord 34 has been reversed so that the Bicros plug 28 is now plugged into the receptacle 18 and the Cros plug 36 is plugged into the external microphone receptacle 54. In this arrangement, terminals 22, 24 of the internal microphone 14 are no longer shorted together, so that the signal from the internal microphone 14 now reaches the amplifier 12.

Consider now the Cros plug 36. No connection is made to terminal 4*b* of plug 36 so the short circuit connection between terminals 3*b*, 4*b* has no effect. The external microphone 44 is connected only to terminals 1*b*, 2*b*, and 3*b* of the Cros plug 36, so the signal from the external microphone travels as shown through cord 34 and the Bicros plug 28 to the amplifier 12. In addition, since the conductor 42 in the Bicros plug is connected between terminals 1*c* and 4*c*, this conductor by-passes or shorts out resistor R1 so that the signals from the internal microphone signal terminal 22 and the external microphone signal terminal 46 both reach the amplifier signal input terminal 32 in approximately equal proportion (depending on the characteristics of the microphones).

The arrangement in which the signals from the external and internal microphones both reach the amplifier in parallel is called a Bicros connection in the hearing aid industry. The arrangement in which the signal from the external microphone reaches the hearing aid amplifier is called a Cros connection. It will be seen that the cord-receptacle configuration shown in FIGS. 1 and 2 allows either connection to be made depending on which plug of cord 34 is connected to the hearing aid receptacle 18. In other words either a Cros or a Bicros connection can be made simply by reversing the cord 34. The plugs 36, 38 are preferably physically marked with a "C" or a "B" (or with an "M" or an "M") to distinguish them.

Figure 3:
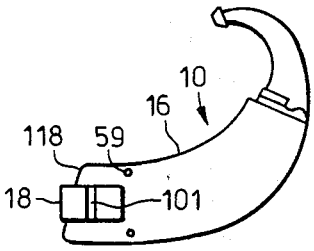
FIG. 3 is a top view showing a hearing aid having a receptacle according to the invention on the housing thereof.
Figure 4:
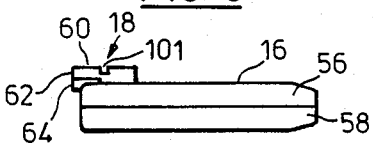
FIG. 4 is a side view of the hearing aid of FIG. 3.
Figure 5:
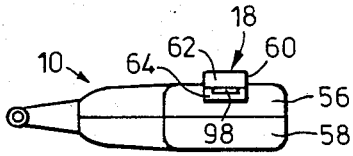
FIG. 5 is an end view of the hearing aid of FIG. 3.

Reference is next made to FIGS. 3 to 8, which show mechanical details of the hearing aid 10 and its receptacle 18. FIGS. 3 to 5 show a plastic hearing aid housing 16 having conventional top and bottom halves 56, 58 which may be fastened together by screws 59. The receptacle 18 has a plastic housing 60 cemented into the top half 56 of the housing 16. The receptacle housing 60 is generally rectangular in form and has top and bottom plastic halves 62, 64.

Figure 6:
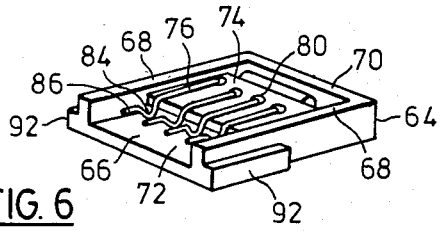
FIG. 6 is a perspective view of the bottom half of the receptacle of the hearing aid.
Figure 7:
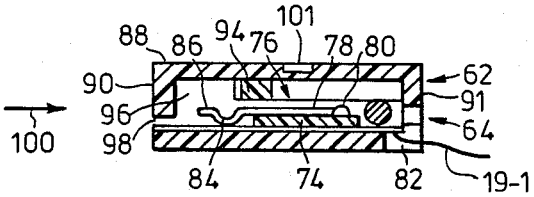
FIG. 7 is a side sectional view of the receptacle of the hearing aid.
Figure 8:
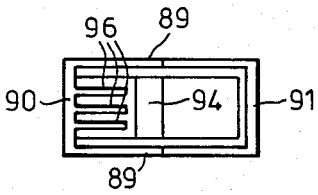
FIG. 8 is a plan view of the inside of the top half of the receptacle of the hearing aid.

As shown in FIGS. 6 and 7, the bottom half 64 of the receptacle housing has a flat bottom wall 66, a pair of side walls 68, and a back wall 70. The front is open at 72 to receive the contacts of a plug as will be described.

Positioned within the bottom half 64 is a small piece of printed circuit (PC) board 74 having four wire spring contacts 76 soldered thereto. Each wire spring contact 76 includes a rear straight portion 78 having its back end soldered at 80 through the PC board 74 to the respective conductors 19-1 to 19-4 which lead to the hearing aid internal microphone and amplifier. Conductors 19-1 to 19-4 extend through an opening 82 in the back wall 70.

Each wire spring contact also has a downwardly extending U-shaped loop 84 which extends slightly below the PC board 74, and a front forwardly extending portion 86. The loops 84 constitute the contacts 1*a* to 4*a*.

The top half 62 of the housing 60 includes a top wall 88, side walls 89 which extend downwardly to and are supported on flanges 92 at the sides of the bottom half 64, and front and rear walls 90, 91. The top half 62 also includes a downwardly extending inner ridge 94 which holds the PC board 74 down, and three parallel downwardly extending plate-like dividers 96 which separate the spring contacts 84 to ensure that they do not touch each other. The top half 62 of the housing 60 is held by the flanges 92 in a position such as to leave a small slot 98 (FIGS. 5 and 7) at the front of the receptacle through which the contacts of a plug may be inserted as indicated by arrow 100. The plug contacts wipe beneath the rounded U-shaped wire loops 84 to effect a firm self-cleaning contact each time the plug is inserted. The top half 62 of the receptacle housing also has a transverse 101 slot in its upper surface, for a purpose to be described.

Figure 9:
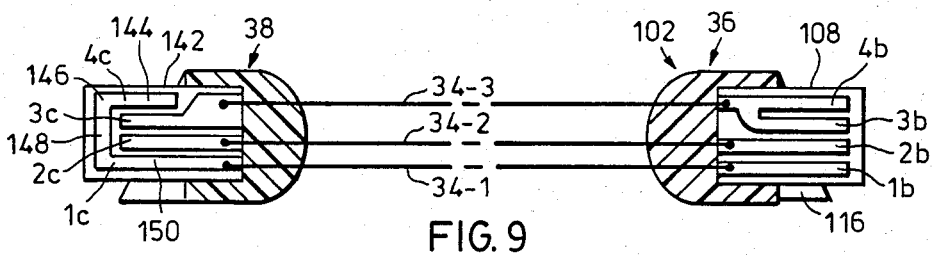
FIG. 9 is a plan view, partly in section and partly schematic, of the cord and plug combination shown in FIGS. 1 and 2.
Figure 10:
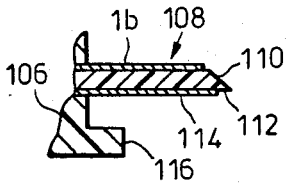
FIG. 10 is a side view, partly in section, of a plug of FIG. 9.
Figure 11:
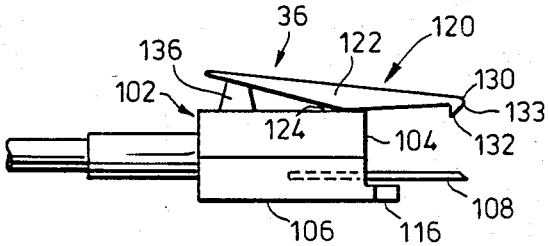
FIG. 11 is a side view of a complete plug of FIG. 9.
Figure 12:
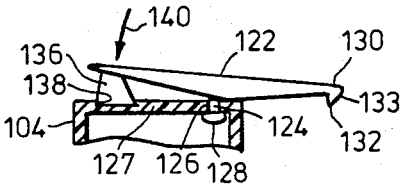
FIG. 12 is a sectional view of a portion of the plug of FIG. 11.
Figure 13:
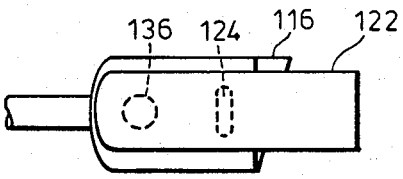
FIG. 13 is a top view of the plug of FIG. 11.

The mechanical details of the plug and cord arrangement are shown in FIGS. 9 to 13. The Cros plug 36 will first be described. The other plugs are similar in mechanical configuration although not in their electrical arrangements. As shown, the Cros plug 36 includes a plastic housing 102 consisting of upper and lower halves 104, 106 solvent welded together. Located within the lower housing half 106 is a piece of PC board 108. As shown in the enlarged view in FIG. 10 the PC board 108 has a tapered front edge 110, and its bottom surface 112 is, except at the edge 110, entirely covered with copper 114 for increased mechanical strength. The top surface of the PC board 108 is etched to provide the four contacts 1*b* to 4*b* respectively, each formed as a longitudinally extending strip of copper. Contacts 3*b* and 4*b* are connected together as shown in FIG. 9 and also shown in FIGS. 1 and 2.

The PC board 108 extends beyond the housing 102 to plug through slot 98 into the receptacle 18. The bottom half 106 of the plug housing includes an integrally formed plastic projecting lip 116 which slants forwardly from one side of the plug 36 to the other. The forward slanting front edge of the lip 116 conforms to the slant of the front surface 118 (FIG. 3) of the hearing aid housing 16 and helps to prevent the plug from "wiggling" up and down after it has been plugged into the receptacle 18.

Mounted atop the upper housing half 104 of the plug 36 is a rocker 120. The rocker 120 includes (see FIGS. 11 to 13) a lever member 122 which as seen from above is generally rectangular and has a flat smooth upper surface adapted to be contacted by a user's finger. Protruding downwardly from the lower surface of the lever member 122 is an integral thin, wide support 124 which extends downwardly through a hole 126 in the upper wall 127 of the plug upper housing half 104. The support 124 is swaged at 128 (by a hot tool which spreads the plastic) to secure it to the upper housing half 104. The forward end 130 of the lever member 122 protrudes beyond the housing 104 and includes a downwardly extending hook 132. Hook 132 has a rearwardly and downwardly sloping front surface 133. The rear end 134 of the lever member 122 is biased upwardly by a small button 136 of resilient plastic such as urethane foam which is glued to a small locating depression 138 in the upper wall 127 of the plug 36.

In use, when the plug 36 is plugged into the receptacle 18, the PC board 108 carrying contacts 1*b* to 4*b* enters the opening 98 and slides beneath the spring contacts 84 as previously described. The contacts 84 wipe over and press down on contacts 1*b* to 4*b*. The sloping surface 133 of the hook engages the front wall 90 of the receptacle top half 62, camming the front of the rocker 120 upwardly and allowing the hook 132 to slide over the top surface of the receptacle 18 until it encounters the transverse slot 101 in the upper surface of the receptacle housing 60. The bias provided by the resilient button 136 then forces the hook 132 downwardly into the slot 101, locking the plug to the receptacle. At the same time, the lip 116 slides beneath the bottom wall 64 of the receptacle 18, helping to provide mechanical rigidity for the engaging parts, and thus preventing the PC board from being broken off.

To disengage the plug from the receptacle the user simply pushes downwardly on the rear of the rocker 120 as indicated by arrow 140. This disengages the hook 132 from the slot 101, allowing the plug to be withdrawn from the receptacle.

It is found that the arrangement described is particularly suitable for users of hearing aids, many of whom are old and have stiff fingers which are not agile. Although the parts are small (since hearing aids are small), only very simple movements are required to engage or disengage the plug from the receptacle, and the lock created by the engagement of hole 132 in slot 101 ensures that the common tendency of a plug to pull out of a receptacle will not occur.

The Bicros plug 38 shown in FIG. 9 is the same as the Cros plug 36, except that (as also indicated in FIGS. 1 and 2), contacts 1*c* and 4*c* are connected together on the PC board 142. The connection is formed by a single strip of copper 144 which begins at the back of the PC board 142, extends forwardly at 146 to a position near the front of the board, then extends across the front of the board as indicated at 148, and then extends rearwardly as indicated at 150. The connection of the two strips of copper 146, 148 is effected at the front rather than at the rear of the PC board 142 so that the rear is left free for connection to the conductors 34-1, 34-2 and 34-3.

Figure 14:
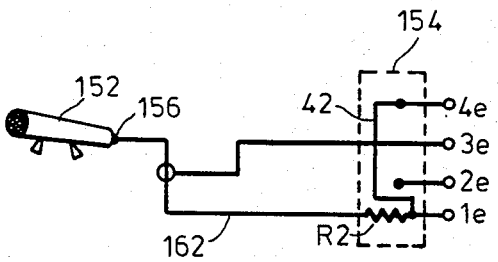
FIG. 14 is a schematic view of a modified plug according to the invention.
Figure 15:
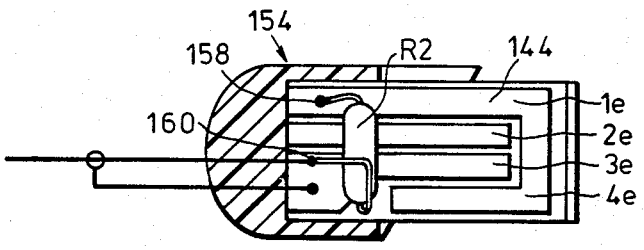
FIG. 15 is a planned view, partly in section of the plug of FIG. 11.

Different plug combinations may be used with the receptacle described, depending upon the external audio input source to be connected to the hearing aid. For example, and as shown in FIGS. 14 and 15, it may be desired to connect an external microphone having a low output impedance to the hearing aid while leaving the internal microphone on (Bicros connection). Such a microphone is shown at 152 in FIG. 14 as connected to a plug 154. The plug 154 includes terminals or contacts 1*e* to 4*e* and is mechanically identical to the plug 38 previously described. Electrically, the microphone signal output terminal 156 is connected through resistor R2 to terminal le, to avoid unduly loading the amplifier 12 and to equalize the signals from the two microphones 152, 14.

Specifically, and as shown in FIGS. 14 and 15, the resistor R2 is located within the plug 154 and one terminal of the resistor R2 is soldered at 158 to the PC board strip 144. The other terminal of resistor R2 is soldered directly at 160 to conductor 162 which extends to the microphone signal output terminal 156. Since the Bicros configuration is used for the plug 154, which is plugged directly into receptacle 18, both microphone inputs reach the ampliifer 12.

Figure 16:
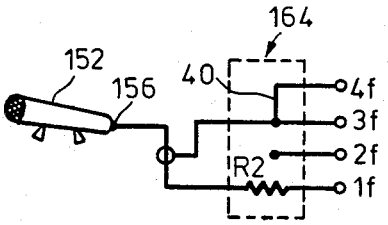
FIG. 16 is a schematic view of another plug according to the invention.
Figure 17:
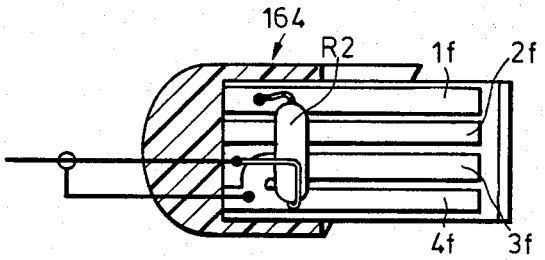
FIG. 17 is a plan view, partly in section, of the plug of FIG. 16.

Alternatively, as shown in FIGS. 16 and 17, the plug 164 connected to microphone 152 may have the Cros configuration, the same as plug 36. In this resistor R2 is connected exactly as in FIGS. 14 and 15, but the copper strips of the plug 164 are configured the same as shown for plug 36 (to provide contacts 1*f*, 2*f*, 3*f*, and 4*f*), so that the internal microphone 14 is shorted out and only the signal from the external microphone 152 reaches the amplifier 12.

Figure 18:
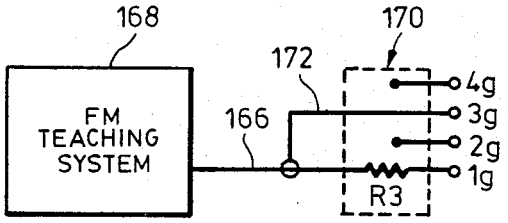
FIG. 18 is a schematic view of another plug and circuit arrangement according to the invention.

Other types of inputs, such as from tape recorders, teaching systems, FM radios, stereos, and the like may also be employed using appropriate plug configurations. For example, FIG. 18 shows a plug configuration for a system known as the "Sennheiser" (trade name) system, which is a well known teaching system having a FM receiver with a variable output impedance. When the FM receiver receives no audio signal, the output impedance of the FM receiver is high; the internal microphone 14 in the student's hearing aid is not loaded, and the sound received at the hearing aid is amplified at its normal level by the amplifier 12. However, when the teacher speaks, the audio signal from the FM system decreases the output impedance of the FM receiver, shunting the internal microphone and allowing the teacher's voice to be received at a louder level than that of the student's class mates. As shown in FIG. 18, the signal output lead 166 from such a teaching system 168 is connected to terminal 1*g* of plug 170 which is arranged in the same Bicros configuration as plug 154. The ground lead 172 for the teaching system is connected to terminal 3*f* of plug 170. No connections are made to terminals 2*f*, 4*f* in plug 170. As shown, a 470 ohm resistor R3 is soldered into plug 170 in series with terminal lf so that a small signal from the internal microphone 14 will remain despite the low impedance of the teaching system 168, so that the voices of persons around the user will continue to be heard at least to a slight extent.

With the arrangement shown, standard hearing aids lacking the receptacle 18 can be fitted with new top halves 56 containing the receptacle 18; only a few wires need then be connected and the hearing aid can be used in the alternative Cros or Bicros arrangement described.

We claim:

1. An electrical connection cord having a first plug at one end thereof and a second plug at the other end thereof, said cord having a plurality of conductors joining the plugs, each plug having a plurality of contacts, the contacts of said first plug being connected to said conductors in a first circuit configuration, the contacts of said second plug being connected to said conductors in a second circuit configuration different from said first circuit configuration, the contacts of both said plugs being adapted to be plugged one plug at a time into a single receptacle, whereby an electrical connection to said receptacle may be varied dependent on which of said plugs is plugged into said receptacle.

2. The combination according to claim 1 wherein said contacts are formed from printed circuit board.

3. The combination according to claim 2 wherein each said plug has a housing, said contacts protruding beyond said housing, and a rocker mounted on each housing for rocking movement, said rocker having an end projecting beyond said housing, said end of said rocker having engagement means thereon for engaging said receptacle and locking said plug to said receptacle.

4. The combination according to claim 1, 2 or 3 wherein said cord has a first number of said conductors and each plug has a second number of said contacts, said second number being greater than said first number.

5. An electrical connection cord and receptacle combination comprising:

(a) a receptacle having a plurality of receptacle contacts, (b) an electrical connection cord having a first plug at one end thereof and a second plug at the other end thereof, said cord having a plurality of conductors joining said plugs, each plug having a plurality of contacts, the contacts of said first plug being connected to said conductors in a first circuit configuration, the contacts of said second plug being connected to said conductors in a second circuit configuration different from said first circuit configuration.

(c) the contacts of both said plugs being adapted to be plugged one plug at a time into said receptacle, whereby an electrical connection to said receptacle may be varied dependent on which of said plugs is plugged into said receptacle.

6. The combination according to claim 5 wherein said receptacle is part of a hearing aid, said hearing aid including an internal microphone, said first circuit configuration including means when said first plug is in said receptacle to turn off said internal microphone, said second circuit configuration including means when said second plug is in said receptacle to leave said internal microphone in operative condition.

7. The combination according to claim 6 wherein said hearing aid includes an amplifier, and resistor means normally connected between said internal microphone and said amplifier, and said second circuit configuration includes means for connecting a short circuit in parallel with said resistor means.

8. The combination according to claim 7 wherein said plug contacts are formed of printed circuit board.

9. The combination according to claim 8 wherein each plug has a housing, said contacts projecting from said housing, and a rocker on said housing and mounted thereon for rocking movement, said rocker having an end portion having hook means, said receptacle having a slot in an outer surface thereof for engagement by said hook means, so that said plug may be locked to said receptacle.

10. The combination according to claim 9 including bias means for normally biasing said hook means into engagement with said slot.

11. The combination according to claim 10 wherein said housing of said plug includes a lip spaced on the opposite side of said contacts from said rocker and extending from said housing in the direction of projection of said contacts, said lip being parallel with said contacts and engaging an outer surface of said receptacle when said plug is plugged into said receptacle, whereby said receptacle is sandwiched between said lip and said rocker when said plug is plugged into said receptacle.

12. The combination according to claim 10 wherein said receptacle includes a plurality of wire spring contacts mounted for said plug contacts to slide therebelow, said wire spring contacts being biased to apply pressure against said plug contacts so that said wire spring contacts will wipe over said plug contacts when said plug is inserted into said receptacle.

13. The combination according to claim 5, 6 or 8 wherein said cord has a first number of said conductors and said plugs and said receptacle each have a second number of said contacts, said second member being greater than said first number.

* * * * *